US006270077B1

(12) United States Patent
Cohen

(10) Patent No.: US 6,270,077 B1
(45) Date of Patent: Aug. 7, 2001

(54) NON-COMPETITIVE MEMORY ENHANCEMENT GAME

(76) Inventor: Gene D. Cohen, 10225 Montgomery Ave., Kensington, MD (US) 20895

( * ) Notice: Subject to any disclaimer, the term of this patent is extended or adjusted under 35 U.S.C. 154(b) by 0 days.

(21) Appl. No.: 09/468,205

(22) Filed: Dec. 20, 1999

(51) Int. Cl.[7] ..... A63F 3/00

(52) U.S. Cl. ..... 273/273; 273/236; 273/272; 273/292; 273/302; 273/308

(58) Field of Search ..... 273/273, 431, 273/240, 429, 430, 243, 269

(56) References Cited

U.S. PATENT DOCUMENTS

| | | | | |
|---|---|---|---|---|
| D. 254,558 | | 3/1980 | Rice . | |
| D. 283,632 | | 4/1986 | Moore . | |
| D. 373,603 | | 9/1996 | Moradinia . | |
| 1,539,015 | | 5/1925 | Mitchell . | |
| 3,208,754 | | 9/1965 | Sieve . | |
| 4,194,305 | * | 3/1980 | Smith et al. | 35/42 |
| 4,449,710 | | 5/1984 | Davis . | |
| 4,640,510 | | 2/1987 | Braddock et al. . | |
| 4,640,513 | * | 2/1987 | Montijo | 273/249 |
| 5,004,244 | | 4/1991 | Johnson . | |
| 5,439,232 | * | 8/1995 | Pollock | 273/431 |
| 5,507,497 | | 4/1996 | Sivak . | |
| 5,855,370 | | 1/1999 | Stoughton, Jr. . | |
| 5,882,008 | | 3/1999 | Siegesmund . | |
| 5,918,882 | | 7/1999 | Truong . | |

FOREIGN PATENT DOCUMENTS

| | | | | |
|---|---|---|---|---|
| 4408583-A1 | * | 9/1995 | (DK) | A63F/9/00 |
| 1469067 | | 3/1977 | (GB) . | |

* cited by examiner

*Primary Examiner*—Jeanette Chapman
*Assistant Examiner*—Alvin A. Hunter, Jr.
(74) *Attorney, Agent, or Firm*—Richard C. Litman

(57) ABSTRACT

A non-competitive memory enhancement game serves to stimulate the memories of persons suffering from memory loss due to Alzheimer's disease stroke, head injury, or other reasons. The present game includes a series of subject areas or categories, with each of the categories being further divided into general knowledge and individualized or personalized knowledge areas. A series of memory cards is provided corresponding to the various general knowledge subject areas, with a series of transparent envelopes also being provided for the insertion of pictures and related questions or comments therein for the construction of personalized memory cards for individual players. A game board or other suitable playing device is provided with a series of playing positions corresponding to the subject areas of the game. Movement about the playing surface during the game is determined by chance, e.g., tossing a single cubical die, or by randomly drawing a subject area card corresponding to the various subject areas of the game. The game may be played by one or more players, with other participants (family members, friends, volunteers, etc.) serving to draw the memory cards and ask questions or discuss points related to the memory cards. The object of the game is to share memories among the players by discussing the pictures displayed on the memory cards, with no competitive aspects being involved. However, rewards (favorite snack or activity, etc.) may be provided to players after a predetermined number of plays or a predetermined period of play, etc., as desired.

16 Claims, 10 Drawing Sheets

NON-COMPETITIVE MEMORY ENHANCEMENT GAME

BACKGROUND OF THE INVENTION

1. Field of the Invention

The present invention relates generally to non-competitive leisure time activities, and more specifically to a game which may be played by the elderly or others with memory impairment or difficulty. The present game is preferably played by one or more persons using a game board, with assistance being provided to the host player(s) by others during play.

2. Description of the Related Art

It is well known that many elderly persons suffer increasing loss of memory with advanced age, due to Alzheimer's disease and other factors. Memory loss is not limited only to the elderly, however, with victims of head injuries, strokes, and other injuries and illnesses also often suffering from memory loss. The loss of memory associated with aging, head injuries, and certain illnesses is generally most frustrating to persons suffering from such memory loss, and can lead to depression and other problems as well. While significant advances in therapy and treatment have been made in attempts to treat such problems over the years, it has proven difficult to reverse such memory loss, particularly due to age.

Various activities have been used for treating such memory loss, such as the use of board games played with and by persons suffering from memory loss. In many instances, such board games can provide mental stimulus and can be of great value in assisting persons in the maintenance of memory or memory training. However, most such games and activities are competitive, and this competitive atmosphere can be discouraging for many persons who suffer from loss of memory, resulting in further frustration for such players. Also, such games are not geared to personal memories of the participants, but rather require general knowledge or skills (e.g., "Trivial Pursuit," tm) which are quite often difficult for a memory impaired person to demonstrate.

Accordingly, a need will be seen for a non-competitive memory enhancement game which may be played by one or more persons. A game board may be provided with a playing path including a series of categories of questions, with the questions relating to general knowledge or personal memories. Questions relating to personal memories may be developed by friends, relatives, and/or acquaintances of the player(s), and provided in visual form (photos, etc.) and/or written or text form, as desired. Questions may have different levels generally corresponding to the degree of memory impairment of the individual player(s).

A discussion of the related art of which the present inventor is aware, and its differences and distinctions from the present invention, is provided below.

U.S. Pat. No. 1,539,015 issued on May 26, 1925 to Paul Mitchell, titled "Dice," describes a generally cubical die or dice having beveled edges between each face. Mitchell discloses such a die having Roman numerals thereon. The present invention may make use of such a Roman numeral die in a relatively large size (i.e., on the order of about one inch across), for ease of viewing by players. However, Mitchell does not disclose any form of game, either competitive or non-competitive, for play with his dice.

U.S. Pat. No. 3,208,754 issued on Sep. 28, 1965 to Fredda F. S. Sieve, titled "Dice Game With A Tetrahedron Die," describes numbered dice comprising regular polyhedrons having tetrahedral, cubical, octahedral, dodecahedral, and icosahedral configurations. Sieve also discloses a competitive game which may be played using such dice. However, no non-competitive game, or game of memory enhancement, is disclosed by Sieve.

U.S. Pat. No. 4,449,710 issued on May 22, 1984 to Norman A. Davis, titled "Game Board, Die And Reward Determining Game Apparatus," describes a game having a board with a plurality of radially disposed playing paths each leading to a common central winner's position. Players are to solve "life situation problems" (no examples are given by Davis), according to random selection. The present game does not include any winner's position on the board, as the game is non-competitive. Also, the present game is not directed to solving problems, as such solutions may be beyond the abilities of some players, but rather to enhancing memories of people, places, events, etc. from the past.

U.S. Pat. No. 4,640,510 issued on Feb. 3, 1987 to John C. Braddock et al., titled "Non-Competitive Game For Two Or More Players," describes a game having a series of tokens representing certain quantities of time. Players acquire the tokens and use them to place demands upon other players for their time. The time may be used later for various activities, e.g., a day trip, a dinner out, etc. The Braddock et al. game does not relate at all to any form of memory recollection or enhancement, as provided by the present memory enhancement game.

U.S. Pat. No. 5,004,244 issued on Apr. 2, 1991 to Gary K. Johnson, titled "Memory Game," describes a board game having a peripheral playing path with a plurality of playing positions. Each playing position includes a series of different categories, whereas the playing positions are each distinct from one another and comprise different subject areas in the present game. More importantly, the Johnson memory game is competitive, while the present game is non-competitive, with participants assisting the host player to remember various people, places, things, and events associated with his or her past. The Johnson memory game does not provide any pictorial means for illustrating personal or general effects or incidents from the past of the host player, as provided by the present non-competitive memory game. The Johnson game is thus more akin to a trivia type game, where verbal responses to questions pertaining to general knowledge are required, than to the present game.

U.S. Pat. No. 5,507,497 issued on Apr. 16, 1996 to Anne M. Sivak, titled "Random Category Naming Game," describes a game having a plurality of categories arranged as arcuate segments of a circular board. A single die is tossed onto the board, with the player required to list a series of responses according to the category upon which the die comes to rest and the number facing upwardly on the die. The Sivak game is competitive in nature and does not provide any means of enhancing personal memories for any of the players, as provided by the present memory enhancement game.

U.S. Pat. No. 5,855,370 issued on Jan. 5, 1999 to George E. Stoughton, Jr., titled "Memory Enhancing Game," describes a game having a series of blank tiles and a series of tiles with indicia on one face thereof. Players are assigned a number of blank and marked tiles, and place some of the blank and marked tiles facing downwardly in a random array while retaining others. Players must remember the locations of their blank and marked tiles, and attempt to exchange blank tiles for marked tiles which they hold. The Stoughton, Jr. game is competitive and does not have a game board or playing path, nor does it provide any questions or remarks about people, places, and events, either generally or relating to personal experiences of one or more players, as provided by the present non-competitive memory enhancement game.

U.S. Pat. No. 5,882,008 issued on Mar. 16, 1999 to Kenneth A. Siegesmund, titled "Board Game Apparatus And Method Involving Answering Objective And Subjective Questions," describes a competitive game having a series of playing positions providing the players with a choice of answering either an objective or subjective question, as desired. Incorrect responses require the player's marker to be set back a predetermined number of positions on the board. The Siegesmund game is more closely related to other competitive trivia type games than to the present game. Siegesmund does not provide any means for enhancing personal memories of the host or other players, as provided in the present game.

U.S. Pat. No. 5,918,882 issued on Jul. 6, 1999 to Nhan D. Truong, titled "Game For Testing Acuity Of The Senses," describes a board game having a series of categories related to the senses, arranged in a radial array. Players are required to describe an article based upon its characteristics by touching, tasting, smelling, hearing, or seeing the object, according to the category and the specific question card drawn. The Truong game is competitive, and does not provide any means for enhancing the memories of players, as provided by the present game.

U.S. Pat. No. D-254,558 issued on Mar. 25, 1980 to James A. Rice, titled "Game Die," illustrates a design for a cubical die having different means for indicating the number represented on each face thereof. The Rice game die teaches away from the preferred die of the present game, due to the need for clarity and simplicity for players of the present game.

U.S. Pat. No. D-283,632 issued on Apr. 29, 1986 to John R. Moore, titled "Game Die," illustrates different design embodiments for a ten sided die with curved faces. The Moore die is considerably more complex than the simple cubical die with its clearly numbered faces, which may be used as the chance means for determining movement about the board of the present game.

U.S. Pat. No. D-373,603 issued on Sep. 10, 1996 to Iraj Moradinia, titled "Die For Playing A Board Game," describes a four sided die having rounded opposite ends. The faces are marked with a series of lines or Roman numerals, rather than Arabic numerals as desired in the present game.

Finally, British Patent Publication No. 1,469,067 published on Mar. 30, 1977 to Charles S. Williams, titled "Visual Aid Question And Answer Game," describes a competitive game having a board with a series of separate tracks or paths, one for each player or team. Questions relate to a given subject, rather than ranging over a number of different general and individualized subjects or questions relating to the specific past history of a host player or players, as in the present non-competitive game. While Williams provides blank cards for additional questions, the questions always relate to a single specific subject area, unlike the more generalized questions of the present game. Also, advance about the Williams board is based upon correctly answering a question, whereas no such requirement for advance exists in the present game.

None of the above inventions and patents, either singly or in combination, is seen to describe the instant invention as claimed.

SUMMARY OF THE INVENTION

The present invention comprises a non-competitive memory enhancement game for play by the elderly, stroke victims, and/or others who may suffer from memory loss or impairment. The present game is played by persons suffering from memory loss, with the assistance of family members, friends, and/or volunteers who coordinate the play of the game. A series of questions are provided to the players, with the questions being divided into a series of separate categories or general subject areas. These categories or subject areas correspond to a like series of playing positions, preferably arranged peripherally about a game board. The questions may be further distinguished as general knowledge or personalized, with the personalized or individualized questions being developed by family, friends, and others from personal memorabilia (photos, etc.) provided by the player (s), and/or friend(s) and family of the player(s) Movement to various positions about the board is determined by chance means (a cubical die, drawing a category card, spinner, etc.).

The questions are provided in the form of a photograph or other pictorial image on one side of a memory card, with questions and/or comments relating to the photo or picture being provided on the opposite side. The present game includes a series of transparent envelopes for containing photos and pictures and their related questions and comments in a back-to-back array, to provide individualized or personalized memory cards for players of the game. In this manner, volunteers or others who have no knowledge of the personal life experiences of the player may participate with the player in the game, by reading the comments and questions to the back of the photo or picture. The picture serves as a "flash card" type device to stimulate the player's memory, and the comments on the reverse side provide further stimulation and a basis for discussion between the player and others.

As noted further above, the present game is not competitive. While all persons taking part in the game may be considered as "players" with the common goal of providing an enjoyable time and recalling memories for those participants or players with impaired memories, it will be seen that two or more such players may take part, with no final goal or winning position being provided on the board. Rather, a player or players may receive a reward (favorite snack, walk or other activity, etc.) after participating for a predetermined period of time or number of plays. The object of the game is to share memories among the participants in the game by discussing the pictures, questions, and comments of the general and personalized memory cards provided with the game, rather than competing against one another.

Accordingly, it is a principal object of the invention to provide an improved non-competitive game for enhancing the memories of players, with the assistance of other participants.

It is another object of the invention to provide an improved memory enhancement game which provides encouragement for relatives and friends to visit persons suffering from memory impairment, by providing a medium of communication through the present game.

Yet another object of the invention is to provide an improved memory enhancement game including a series of questions comprising a plurality of different subject areas or categories, with each category being further divided into general and personalized or individualized questions.

It is a further object of the invention to provide an improved memory enhancement game which individualized or personalized questions are developed from memorabilia relating to the individual life experience of the player or players of the game.

An additional object of the invention is to provide an improved memory enhancement game including a plurality of transparent envelopes for containing a photograph or picture and related questions and comments relating to the individual life experience of the player or players of the game, for providing individualized or customized memory cards for use in the game.

Still another object of the invention is to provide an improved memory enhancement game wherein advancement during play is determined by chance means, with the game being devoid of any set goal or winning position.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention comprises a non-competitive memory enhancement game serving to stimulate and enhance the memory of persons suffering from various forms of moderate to severe memory loss, as may occur with stroke victims, persons suffering from Alzheimer's disease, and other illnesses and/or conditions which lead to memory loss to various degrees. The non-competitive nature of the present game precludes discouragement for players of the game, and provides a basis for interaction between players and other participants, thus encouraging dialogue and discussion.

The present game is adapted for play by one or more "host" players, i.e., persons suffering from memory loss, with the aid of one or more assisting players (family members, friends, volunteers, care facility staff, etc.). The assistants serve to read questions and/or comments relating to various persons, places, events, etc., relating to the life experience of the host player(s), and assist the host player(s) during the game.

Figure 1:
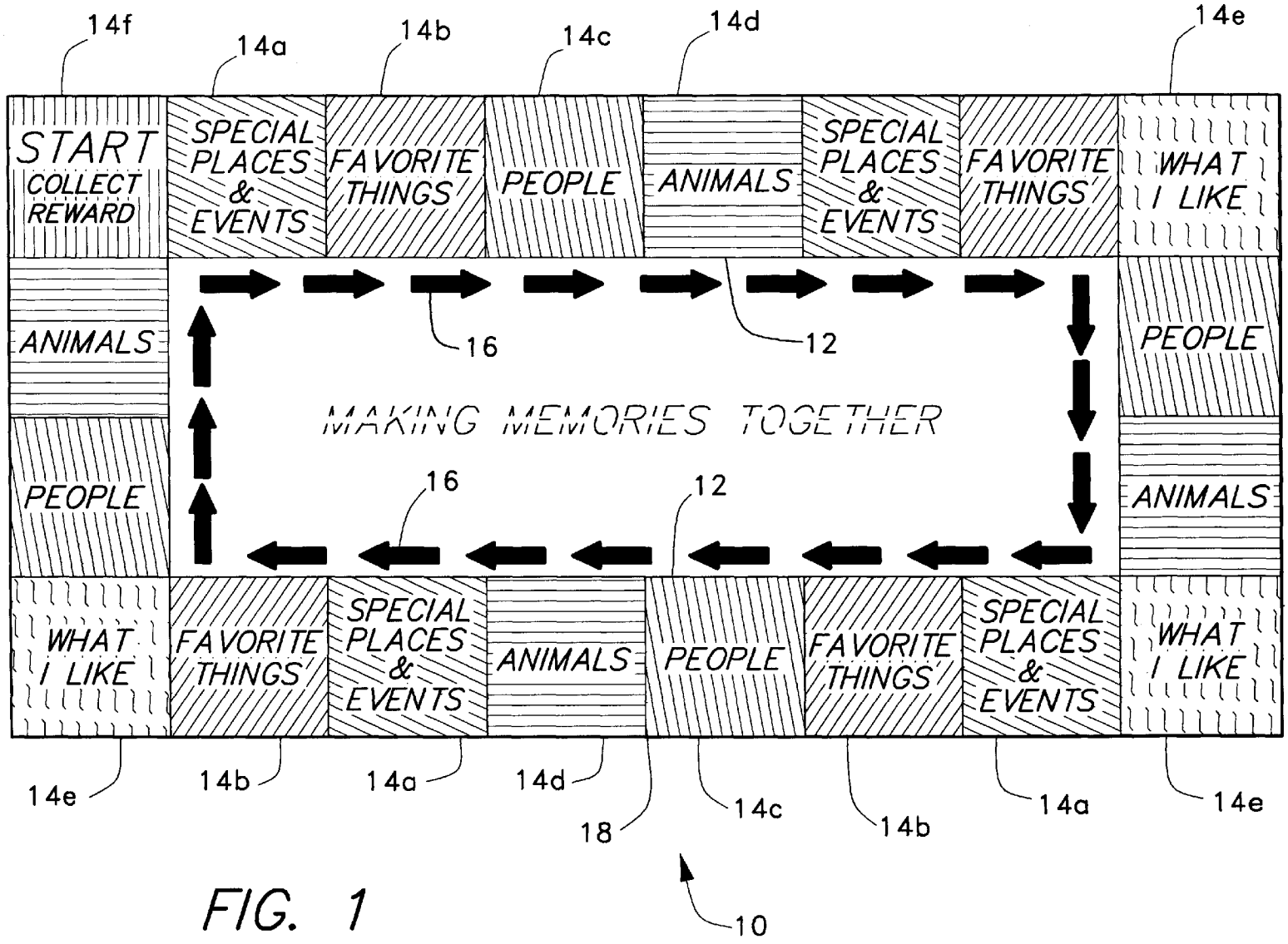
FIG. 1 is a top plan view of an exemplary game board for use in playing the present memory enhancement game.

A playing area, such as the game board 10 of FIG. 1, is provided, with the board 10 having a generally rectangular configuration with a peripheral playing path 12 formed thereon. The playing path 12 comprises a plurality of individual playing positions, with the playing positions being divided into a series of different subject categories. In the exemplary game board 10 of FIG. 1, the playing path 12 comprises "Special Places and Events" playing positions 14*a*, "Favorite Things" positions 14*b*, "People" positions 14*c*, "Animals" positions 14*d*, and "What I Like" positions 14*e*, which allow a player to select freely from any of the categories 14*a* through 14*d* as desired. A single starting position 14*f* is also provided. The various subject categories described for the different categories of playing positions 14*a* through 14*d* are exemplary, and have been found to relate to past interests and life experiences of the majority of persons who might participate in the play of the present game. However, it will be seen that other subject categories may be provided in lieu of, or in addition to, those described in the present disclosure. It should be noted that the playing area or game board 10 is configured for ease of use by persons suffering from various physical and/or mental disabilities. The present game board 10 is preferably a relatively large size, on the order of ten by twenty inches with indicia scaled accordingly, in order to provide good visibility for players having relatively poor eyesight. (Other sizes may be provided as desired.). A series of directional arrows 16, or other means, is provided to indicate clearly the direction of travel during play of the present game.

The playing positions 14*a* through 14*e* of each subject category are preferably colored, shaded, or otherwise marked to distinguish the different categories from one another, e.g., pink for the "Special Places And Events" positions 14*a*, orange for the "Favorite Things" positions 14*b*, blue for the "People" positions 14*c*, green for the "Animals" positions 14*d*, and yellow for the "What I Like" positions 14*e*. The start position 14*f* is further colored, shaded, or marked differently (e.g., red) from the other positions 14*a* through 14*e*, and the word "Start" is in a somewhat larger size than other lettering on the board 10. All of the lettering or indicia of the board 10 is oriented to be read from one primary side 18 of the board, allowing the host player to read clearly all of the subject categories of all of the playing positions 14*a* through 14*e* from that side 18 of the board 10.

Figure 11:
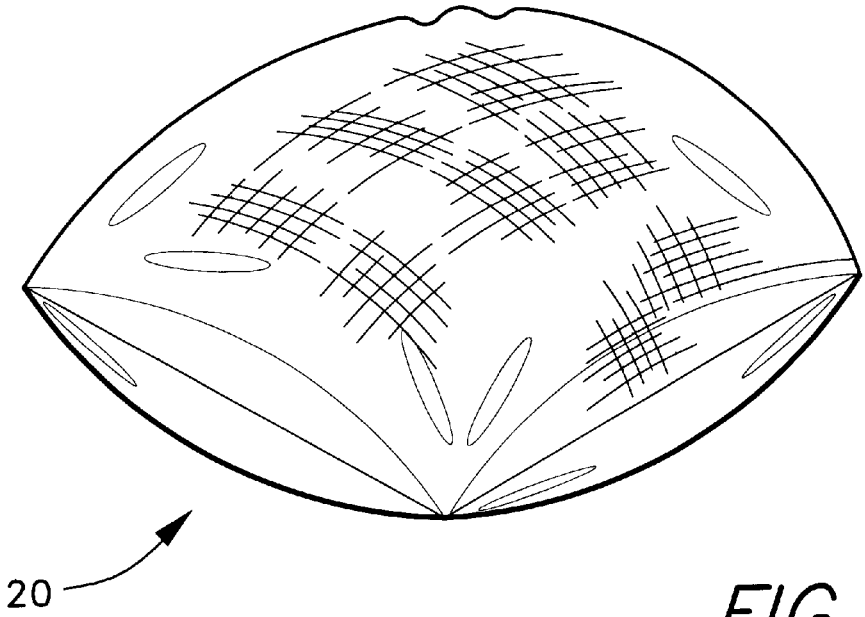
FIG. 11 is a perspective view of the single position marker used in the play of the present game.

Play begins from the start position 14*f*, with a single player position marker 20 (FIG. 11) being placed upon the starting position 14*f*. Only a single position marker 20 is required, as there is no competition in the present game, and thus no need to keep track of separate individual player positions about the playing path 12 of the board 10. Rather, in the event of plural host players, the players take turns sequentially in selecting a subject category (by means discussed below) and moving the single marker 20 to the next corresponding player position of the board 10. The marker 20 is preferably relatively large (e.g., on the order of two inches across, more or less) to preclude loss or ingestion of the device, and is preferably formed in a soft, flexible "bean bag" type configuration to preclude sharp corners, hard surfaces, etc.

Figure 10:
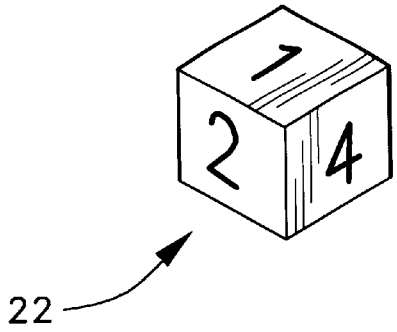
FIG. 10 is a perspective view of three sides of a cubical die serving as chance means for the present game.

Selection of a subject category, and thus movement of the marker 20, may be determined in a number of ways. A six sided, cubical die 22 (FIG. 10) may be used, as is known in other games for determining the magnitude of player moves. Preferably, the die 22 used in the play of the present game is numbered, as shown in FIG. 10, rather than being marked with dots or non-numerical symbols to indicate the six sides or surfaces thereof. The use of Roman numerals is preferred, as such numerals are easier to recognize for the host player suffering from some degree of memory loss or impairment.

Figure 2:
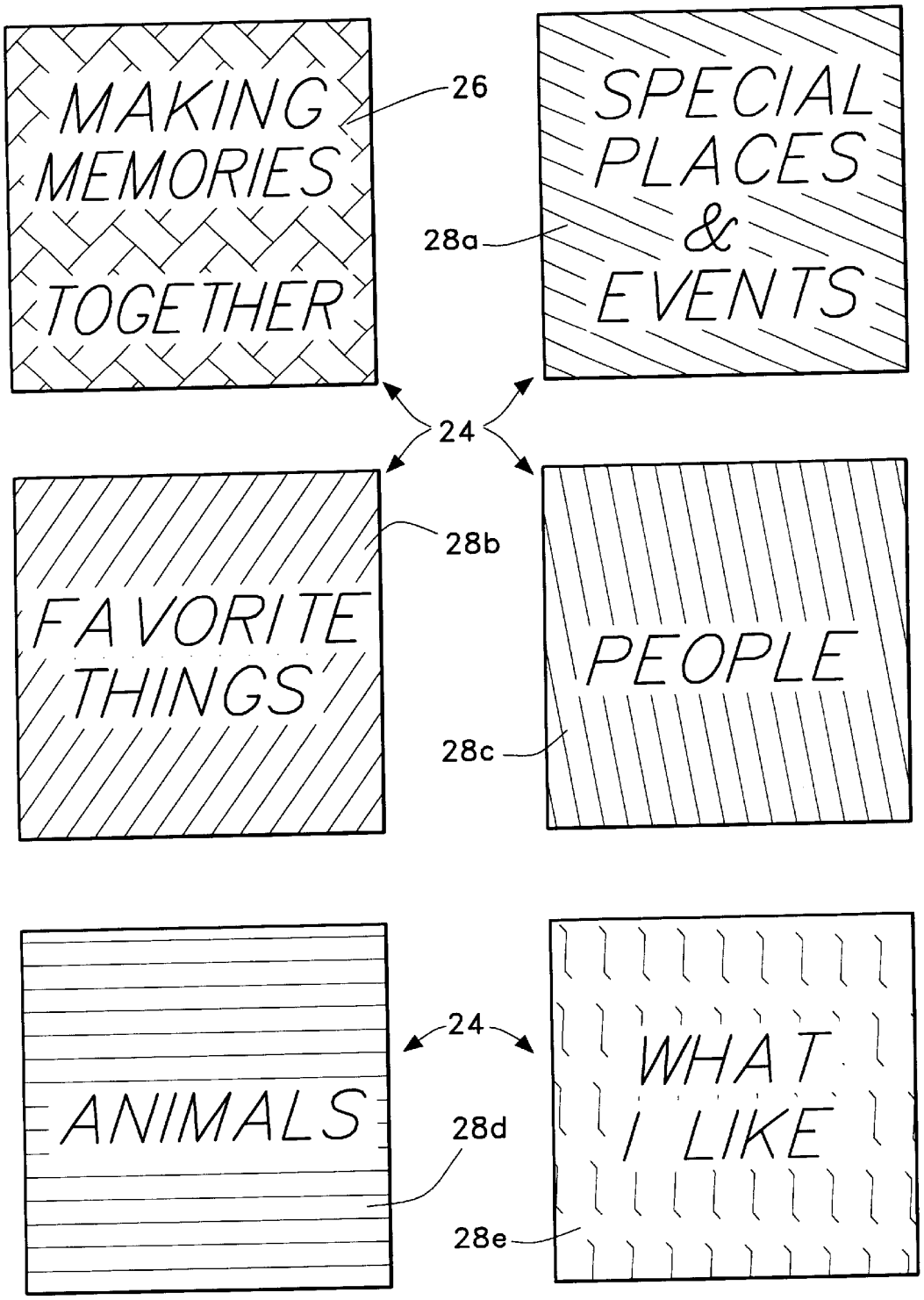
FIG. 2 is a plan view of the front faces of a series of category cards for randomly determining the category of memory card to be selected for play in the present game, and a plan view of the exemplary reverse or back side common to the category cards.

Alternatively, a plurality of category cards 24, as shown in FIG. 2, may be used to determine the extent of each movement of the player marker 20 and corresponding position and subject category of the playing path 12. The category cards 24 each have a common first or front side 26, so as to make each of the cards 24 indistinguishable from one another for random selection thereof when the cards 24 are stacked or placed with their front sides 26 facing upwardly. The opposite second or back faces are designated as 28*a* through 28*e* and correspond to the subject categories of the board positions 14*a* through 14*e*, and are colored, shaded, or otherwise marked correspondingly. Thus, the "Special Places And Events" card has a second or back face 28*a*; the "Favorite Things" card has a second or back face 28*b*; the "People" card has a second or back face 28*c*; the "Animals" card has a second or back face 28*d*; and the "What I Like" card has a second or back face 28*e*.

These cards 24 may be drawn randomly to determine the movement of the player position marker 20 to a corresponding position 14*a* through 14*e* along the playing path 12 of the board 10 in lieu of the single die 22, if so desired. Alternatively, the category selection cards 24 may be "stacked" in order to allow the host player to select a category or categories with which he or she is more comfortable or prefers. In some instances, the chance means (die 20 or cards 24) may be dispensed with during play, with the host player or supporting or assisting players selecting a subject category or categories as desired.

Once a move to one of the playing positions has been selected by means of the category cards 24, numbered die 22, or selection by the host or other player, the marker 20 is moved to the selected playing position and a corresponding memory card is randomly drawn or selected. The memory cards comprise four different general subject areas corresponding to the "Special Places And Events," "Favorite Things," "People," and "Animals" subject areas respectively of the playing positions 14*a* through 14*d* and their corresponding category selection cards. The memory cards of each subject area are further divided into general subjects, i.e., topics and subjects generally regarded as common knowledge, and individualized or personalized subjects relating to the personal life history of the host player.

Figure 3A:
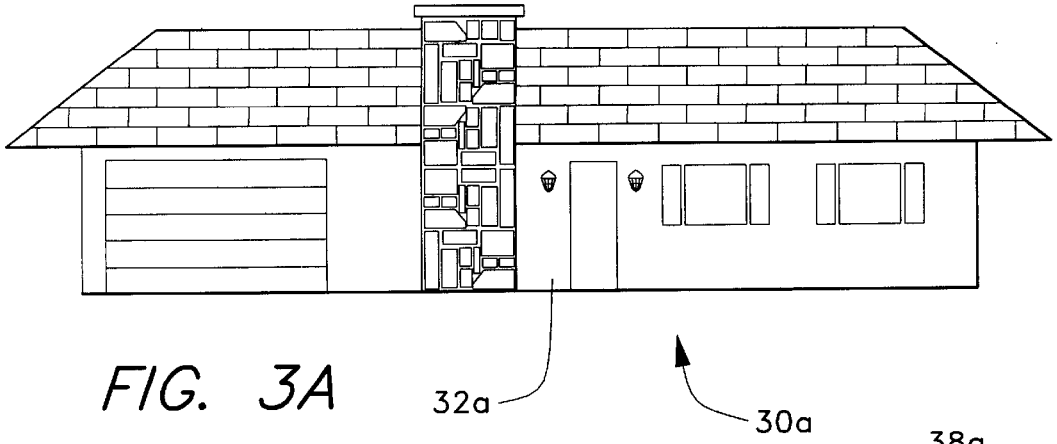
FIG. 3A is an exemplary picture relating to a personalized memory card in a first subject or category of the present game.

Examples of such memory cards are shown in FIGS. 3A through 8B of the drawings. FIGS. 3A and 3B illustrate the first and second sides 32*a* and 34*a* of an individualized or personalized card 30*a*, relating to the "Special Places And Events" positions 14*a* of the present game. The first side 32*a* illustrates a photograph or picture of a place or event of special interest to one of the host players of the game, while the opposite second side 34*a* provides a few comments 36*a* (questions, remarks, etc.) relating to the illustrated place or event 32*a*. The memory cards may be coded to correspond with the related subject areas of the playing positions 14*a* through 14*d*, as by the correspondingly colored "Special Places And Events" area 38*a* of the card 30*a*, or a colored border 38*b* as shown on the second face 35*a* of the card 31*a* of FIG. 4B, etc.

Figure 3B:
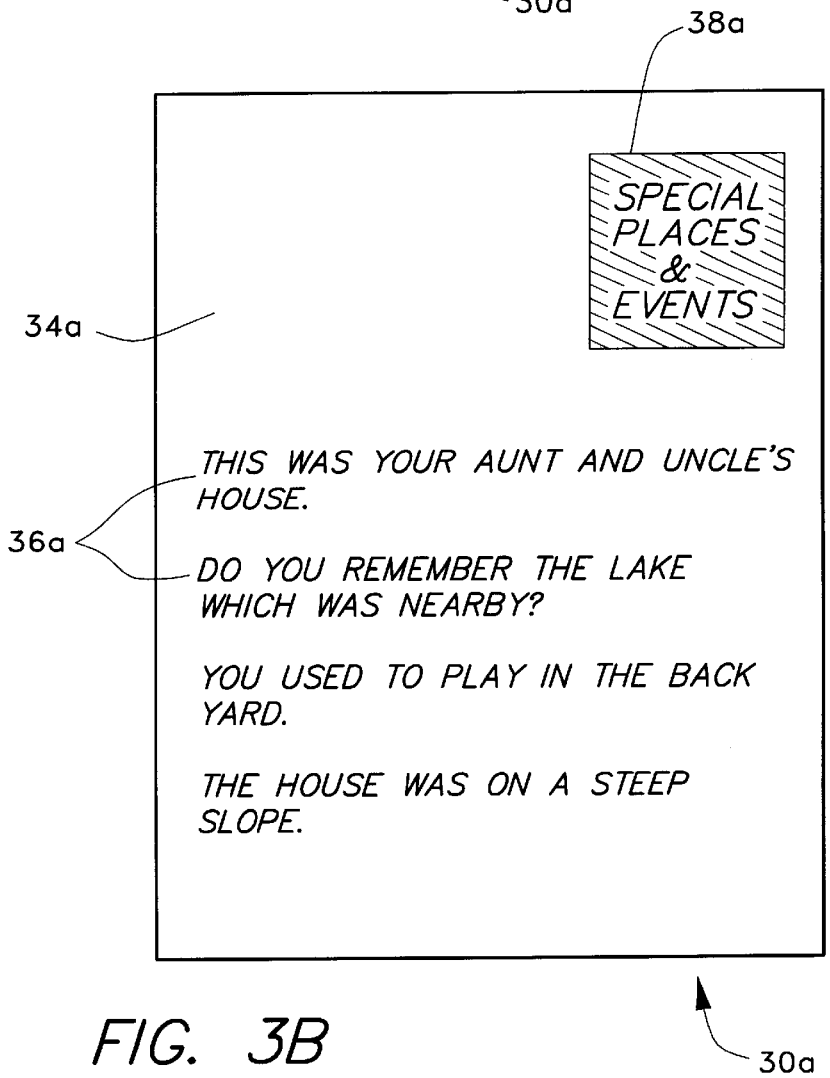
FIG. 3B is a series of questions and comments relating to the picture of FIG. 3A.

The comments provided on each of the memory cards should range from specific questions through more general remarks about the picture or illustration on the opposite side of the card. This reduces or precludes possible frustration on the part of the host player, for such players with severe memory loss. In many instances, such persons are unable to remember clearly such places as childhood homes, pets, close relatives, etc., and the provision of remarks or statements about these memories can assist the host player in remembering, rather than having the host player feel challenged by what to him or her are difficult questions. Assisting players may modify these remarks appropriately, by forming questions as leading questions (e.g., rather than asking "Do you remember this house?" the question may be rephrased, "Was this your Aunt and Uncle's house?"). The memory card 30*a* of FIGS. 3A and 3B provides an example of such, with a picture of a home from the host player's past on the first side 32*a* of the card, and a series of corresponding comments 36*a* on the reverse side 34*a*.

It will be seen that such personalized or individualized memory cards must be custom made for each host player participating in the present game. This is easily accomplished, and the present game may provide for such by means of a series of transparent sleeves or containers which may be provided with the game. A series of sixty (more or fewer) such sleeves may be provided, to agree with the number of premanufactured general memory cards which may be provided with the game. This procedure is illustrated and discussed in greater detail further below in the present disclosure.

Figure 4A:
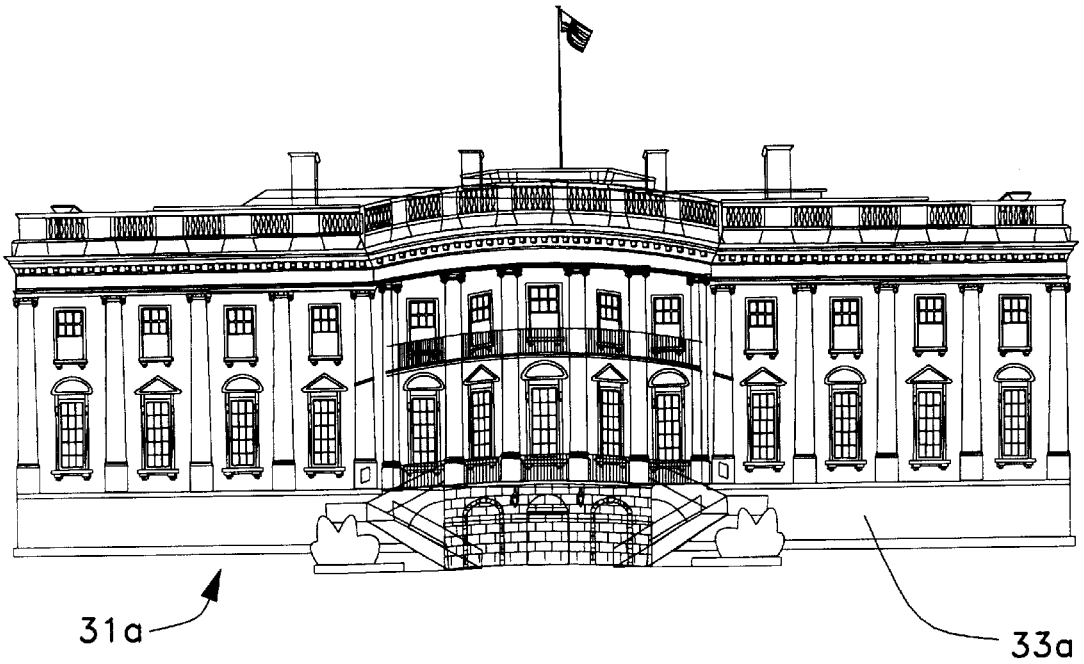
FIG. 4A is an exemplary picture relating to a general memory card in a first subject or category of the present game.
Figure 4B:
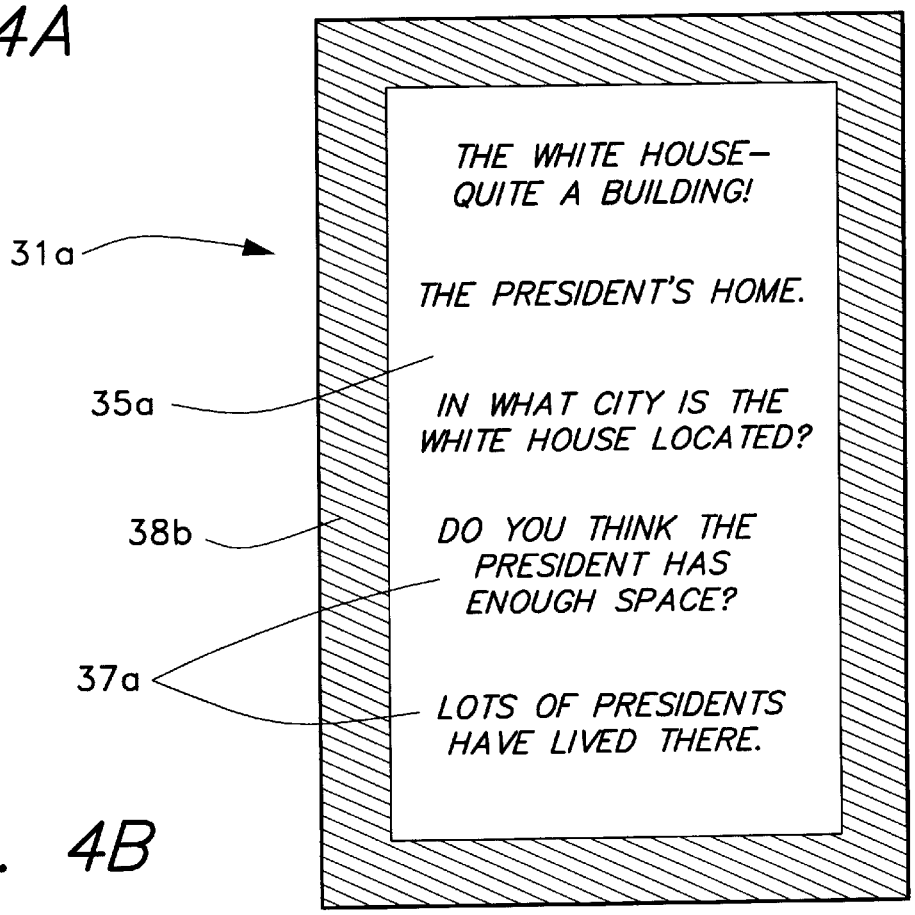
FIG. 4B is a series of questions and comments relating to the picture of FIG. 4A.

FIGS. 4A and 4B illustrate a "special Places And Events" memory card 31*a*, relating to a subject of more general knowledge. Such general subject memory cards may be provided as stock items with the present game, with no further work being required for their use. The front face 33*a* of the general subject card 31*a* illustrates a picture of the White House, with the opposite back side or face 35*a* having a list of comments 37*a* (questions and remarks) relating to the picture on the first side or face 33*a*. It will be seen that a number of other structures or places and corresponding comments may be used in lieu of or in addition to the White House, such as Mount Rushmore, the Golden Gate Bridge, Eiffel Tower, etc. The important consideration here is that the place or event illustrated be generally readily recognized by most persons, so as not to overtax the memory of the host player. Again, the present game is not a competitive trivia game intended to select a single winning player by means of testing his or her arcane knowledge, but is rather a non-competitive memory enhancement game for gently encouraging the retention and enhancement of important memories to the memory impaired host player.

Figure 5A:
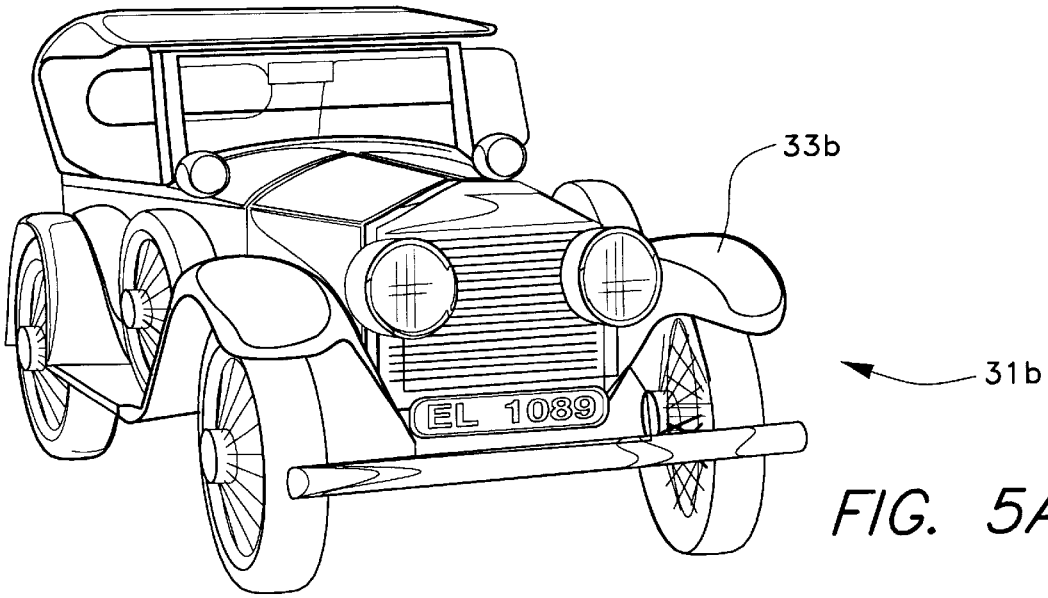
FIG. 5A is an exemplary picture relating to a general memory card in a second subject or category of the present game.
Figure 5B:
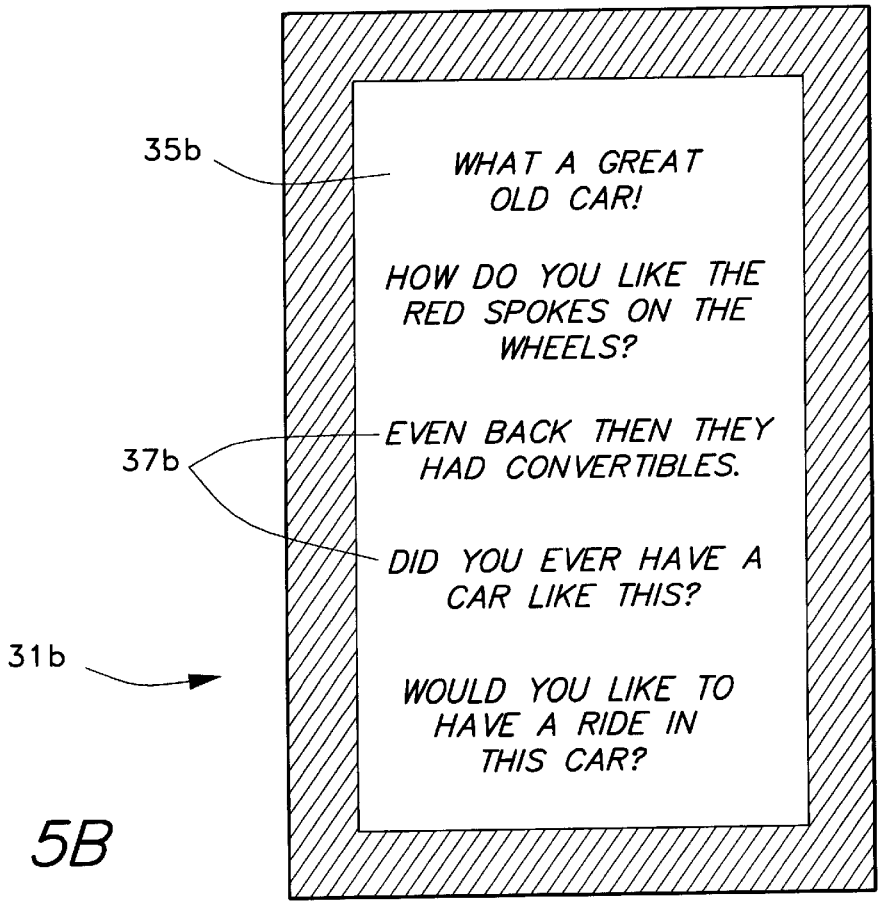
FIG. 5B is a series of questions and comments relating to the picture of FIG. 5A.

FIGS. 5A and 5B disclose a second category of general memory card, relating to the "Favorite Things" playing positions 14*b* of the board 10. The "Favorite Things" general memory card 31*b* has a first side 33*b* with a depiction of some article (car, etc.) generally known to the host player(s), with the opposite second side 35*b* having a corresponding list of general questions and remarks 37*b* relating to the article 33*b* of the first side.

Figure 6B:
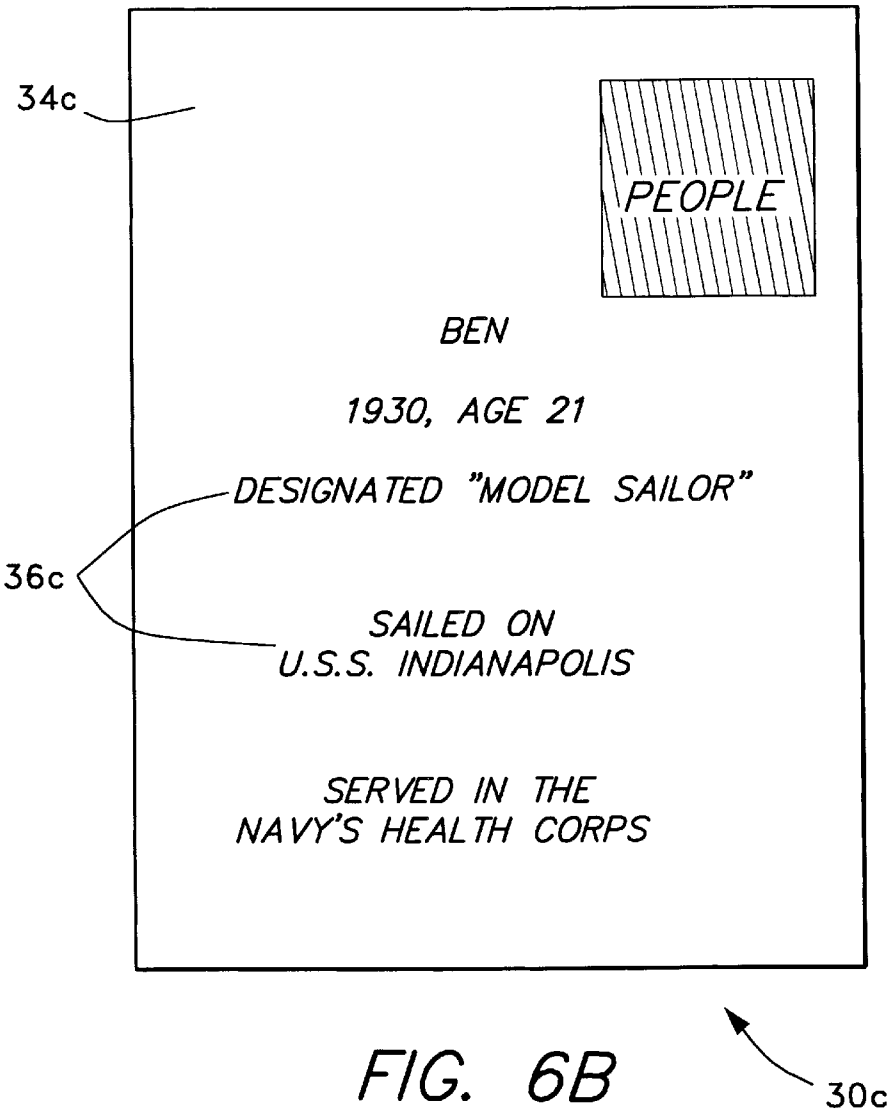
FIG. 6B is a series of questions and comments relating to the picture of FIG. 6A.
Figure 6A:
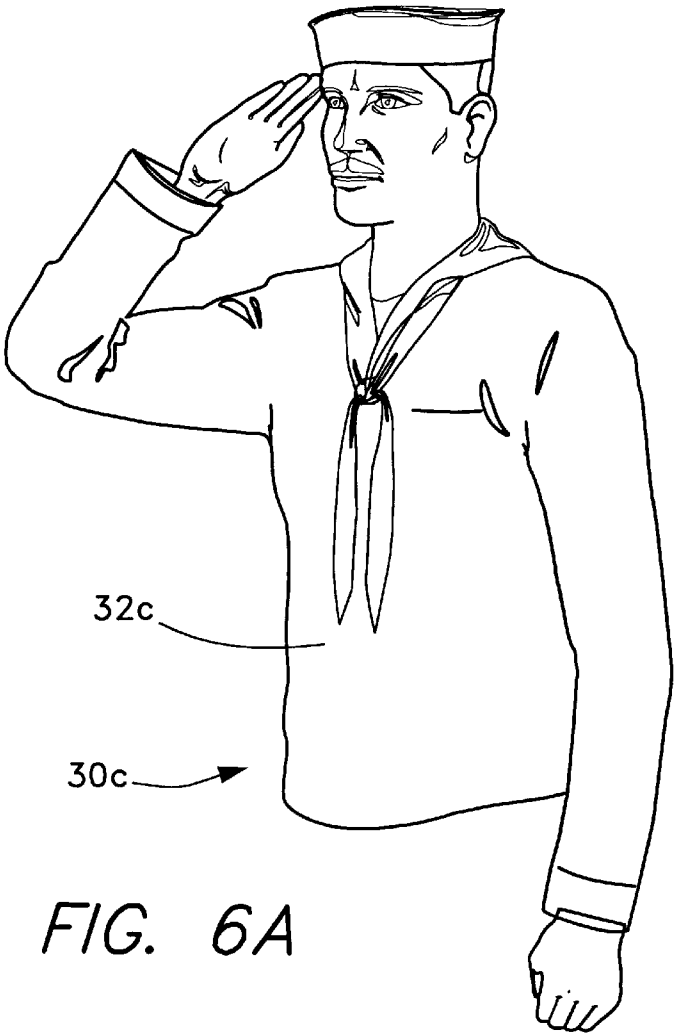
FIG. 6A is an exemplary picture relating to an individualized memory card in a third subject or category of the present game.

FIGS. 6A and 6B illustrate a personalized or individualized "People" card 30*c*, corresponding to the "People" player position category 14*c* of the board 10. A series of such individualized "People" cards, as exemplified by the card 30*c* of FIGS. 6A and 6B, may include a number of friends and relatives whom the host player has known during his or her lifetime. Many such cards may have a currently living person as their subject, but may show a photograph and corresponding remarks or comments from an earlier era during that person's life. In the example of FIGS. 6A and 6B, a photograph of "Ben" in 1930 is shown on the first side 32*c* of the card, with corresponding questions and remarks 36*c* provided on the opposite second side 34*c* of the card 30*c*.

Figure 7B:
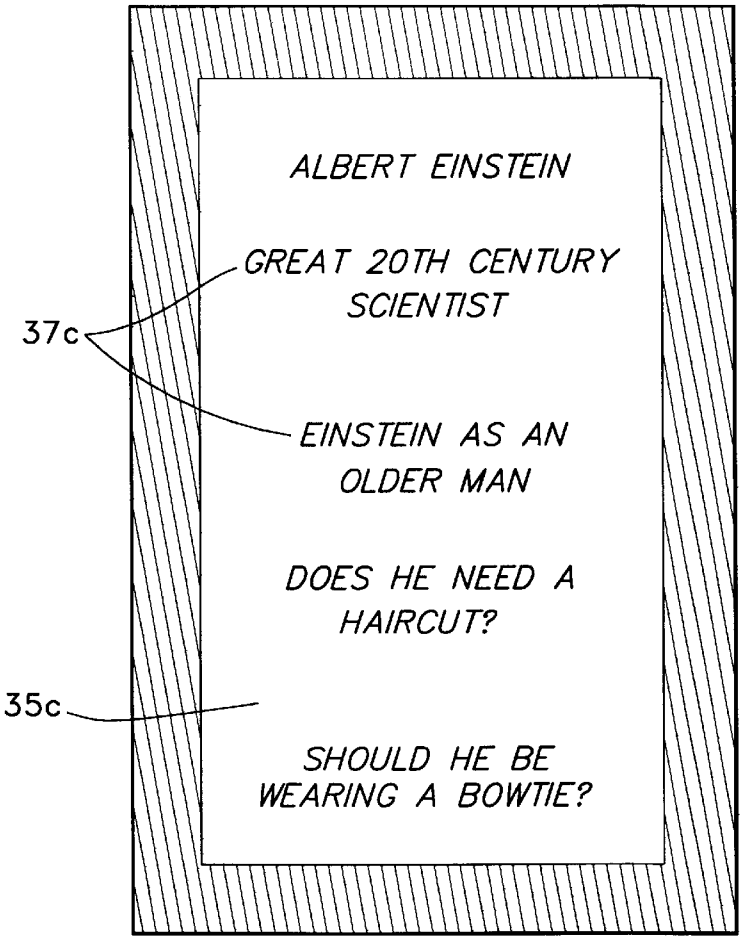
FIG. 7B is a series of questions and comments relating to the picture of FIG. 7A.
Figure 7A:
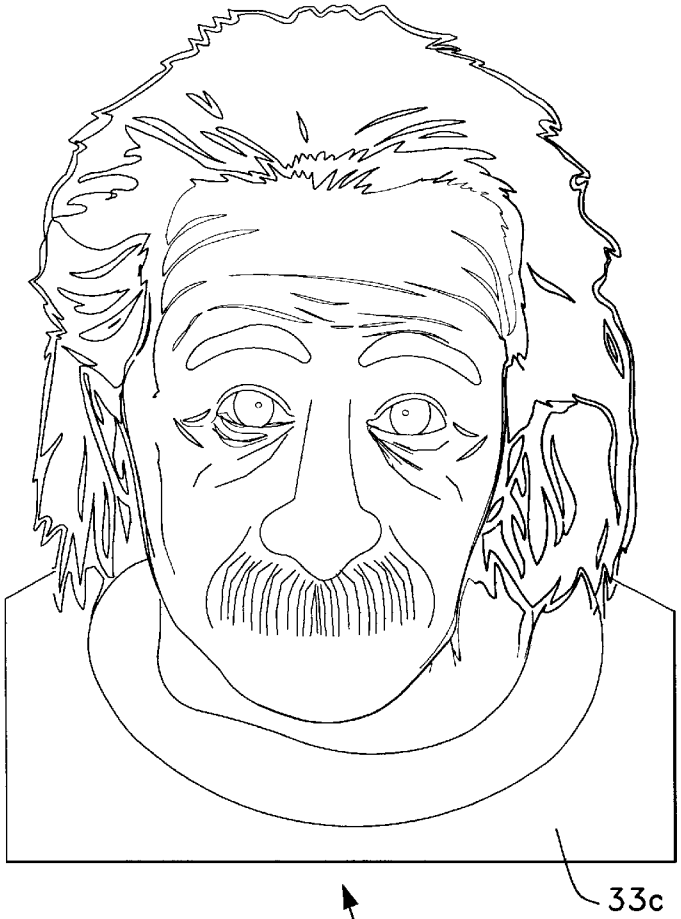
FIG. 7A is an exemplary picture relating to a general memory card in a third subject or category of the present game.

FIGS. 7A and 7B depict yet another type of memory card 31*c*, relating to the "People" category playing positions 14*c* of the board 10, but describing a person generally known to most people rather than an individual special to the life history of a particular host player. The front 33*c* of the "People" card 31*c* illustrates a likeness of Albert Einstein in his later years, with corresponding comments 37*c* in the form of questions and remarks being provided on the opposite second side 35*c* of the card 31*c*. Depending upon the degree of memory impairment of the host player, further questions and remarks may be formulated by the assisting player, perhaps discussing in general the theoretical advances for which Einstein is known, etc. Assisting players may expand upon any of the comments of any of the cards of the present game, depending upon the abilities and wishes of the host player(s).

Figure 8B:
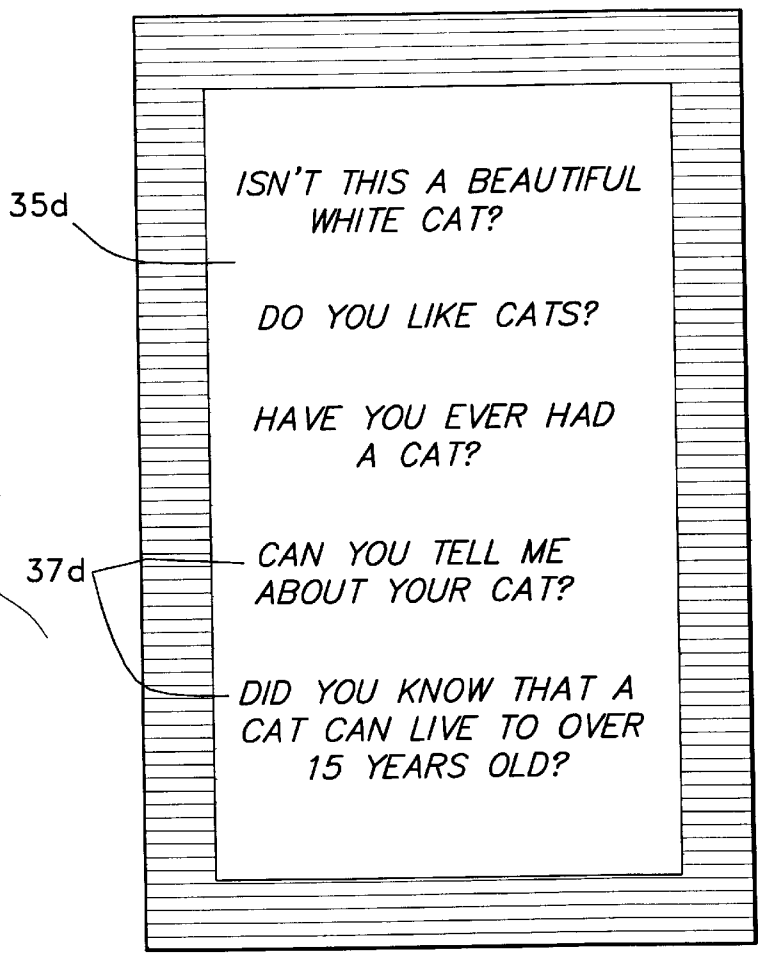
FIG. 8B is a series of questions and comments relating to the picture of FIG. 8A.
Figure 8A:
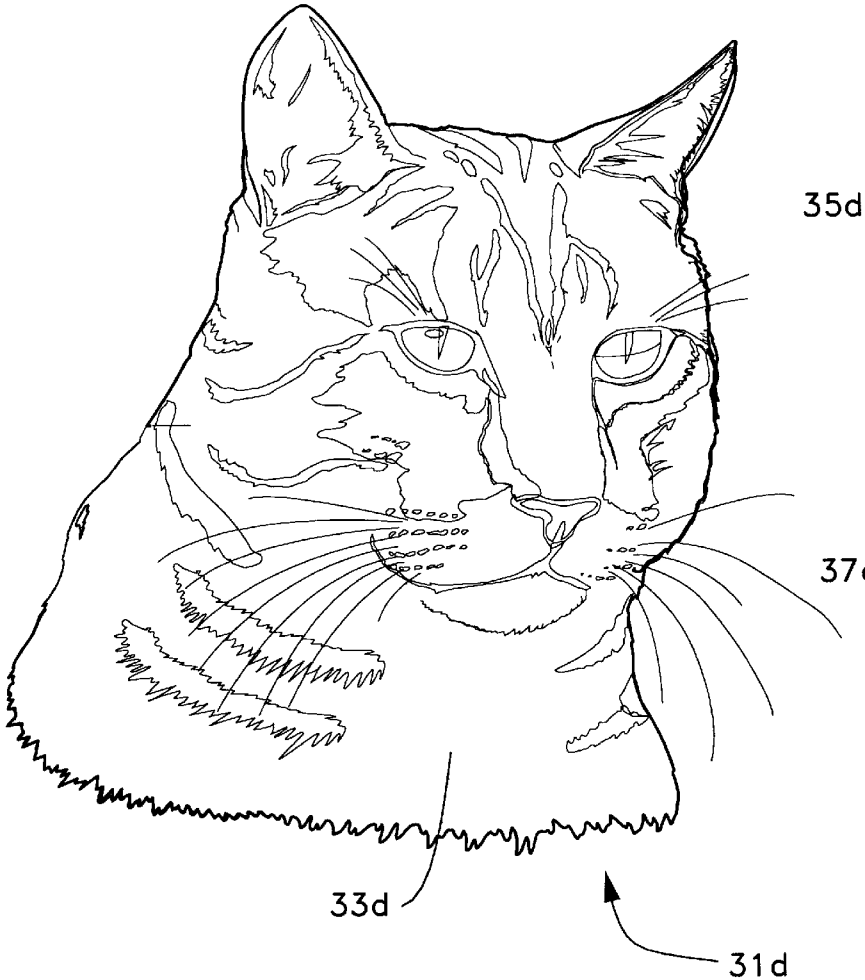
FIG. 8A is an exemplary picture relating to a general memory card in a fourth subject or category of the present game.

FIGS. 8A and 8B illustrate a general memory card 31*d* relating to the "Animals" category playing positions 14*d* of the board 10. As in the other general subject memory cards 31*a* and 31*b* exemplified further above, the card 31*d* may have a first side 33*d* with a generic photograph or picture of a cat (or dog, horse, or other pet, etc.) with a series of general questions and remarks 37*d* provided on the opposite back surface 35*d* of the card 31*d*. If photographs of specific pets of the host player are available, individualized or personalized cards relating to those pets or animals may be constructed, as described below.

As noted further above, the present memory enhancement game includes provisions for "customizing" the game to a great extent, by using photographs (or preferably, copies thereof) of people, places, events, etc. which are special to the individual memory or memories of the host player or players. Family friends, relatives, and/or other volunteers may collect and make color photocopies of photographs relating to the personal life history of the host player, and write or type appropriate questions and remarks upon the reverse side or upon a second sheet. The copy of the photograph and accompanying comments are then inserted into the transparent envelope to provide a customized memory card relating to a single host player of the present game. Various technologies are available for reproducing photographs, such as scanning and printing on a color or black and white printer as appropriate, having copies made through a photo shop or developing service, etc., according to the most expedient and/or convenient technology.

Figure 9:
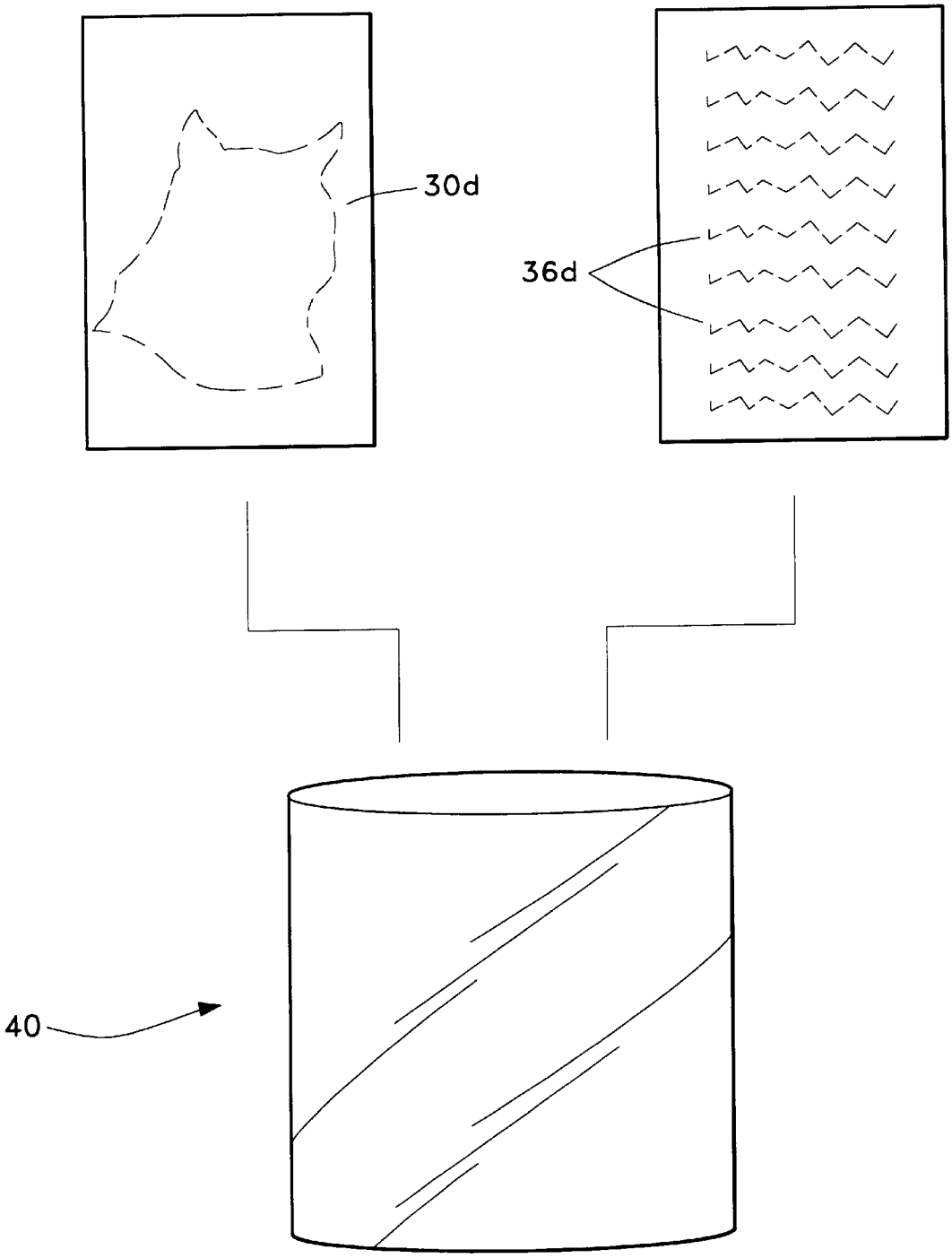
FIG. 9 is an exploded perspective view of a transparent envelope and materials for insertion therein, for forming an individualized or personalized memory card for use in the game.

The present game is equipped with a number of large (e.g., five by seven inches, for clarity) transparent plastic envelopes or sleeves 40, as shown in FIG. 9, for enclosing any customized photos or illustrations used in the formation of individualized or personalized memory cards, such as cards 30*a* and 30*c* respectively of FIGS. 3A, 3B and 6A, 6B. An individualized photo or picture, such as a specific animal photo 30*d* known to one of the host players, is inserted into the envelope or sleeve 40 with the first side or surface facing outwardly, and a series of corresponding comments 36*d* in the form of questions and/or remarks is provided on another sheet (or the back of the first sheet or photo 30*d*), facing outwardly opposite the orientation of the photo 30*d* for viewing through the opposite side of the transparent envelope 40.

When a series of such customized or individualized memory cards has been formed, they may be combined randomly (or in a predetermined order, if desired) for the play of the present game. The playing area (e.g., game board 10) is readied by placing the position marker 20 upon the starting position 14*f*. In the event that more than one host player is involved, the order of play is determined among those host players and assisting players who have elected to play the game. The chance means (category selection cards 24, die 22, or alternatively a spinner, etc.) is used to determine the magnitude of the first move from the starting position 14*f*. (Alternatively, a category may be selected by the host player or assisting player and the marker 20 placed upon the first player position of that category, if so desired.)

The position marker 20 is moved to one of the selected player positions 14*a*, 14*b*, 14*c*, or 14*d* as determined by the chance means or players, and a corresponding memory card is drawn or selected from the group of general and individualized cards provided and constructed for the game. The assisting player may then show the host player the picture or photograph on the first side of the card, with the related text on the opposite side thus facing the assisting player. In this manner, the memory cards of the present game may be considered somewhat like "flash cards," in which some form of visual memory stimulus is provided, with the comments of the opposite side of the card providing for discussion of the pictured person, article, etc.

Again, the discussion need not be limited only to those specific questions and remarks listed on the back of each card. The astute assisting player will recognize the general abilities of the host player, and proceed accordingly with specific questions (e.g., "Do you remember when this picture was taken?"), leading questions (e.g., "Do you know that this picture was taken in 1934, when this car was brand new"), or comments perhaps reforming the questions as statements, and/or further comments about the subject matter of the photo. The object here is to provide the memory impaired host player with pleasant memories of the past, to enforce and enhance those memories, and to help the host player to tie together past memories in a coherent manner, rather than challenging the recall of the player.

Play continues in the above described manner, rotating among the host players (if more than one host player is involved). The memory cards may be selected randomly according to the different subject categories of the peripheral playing path of the game board (i.e., "Special Places And Events," "Favorite Things," "People," and "Animals"), or may be preselected to comprise only one, two, or three categories as desired. The color or coding of the memory cards (border or other marking) to correspond with the related category of the player positions, enables the memory impaired host player to recognize better the connection between the two game components. Further, each of the memory cards of a given category may be divided into general and individualized cards, and play may make use of only one or the other of these divisions if so desired.

In addition to the four different subject areas described above for the memory cards, additional "What I Like" playing positions 14*e* may be provided at various points along the playing path 12 of the board 10. When the position marker is placed upon one of these "What I Like" positions, the host player is allowed to select any one of the other categories described on the positions 14*a* through 14*d* of the board 10. Thus, the "What I Like" positions 14*e* are somewhat analogous to a "wild card," which may be used to represent another card or cards in a card game. The host player may enjoy such an alternative if he or she has been using the chance means to determine the selected category, as he or she may prefer to discuss a memory from a different category than those previously selected.

Play continues until reaching the end of the game, which may be determined in a number of different ways. For example, the end of the game may be reached after completing a predetermined number of laps (one, two, or more, as desired) of the peripheral playing path 12. The starting position 14*f* on the board 10 may also include a "Collect Reward" notation, as shown in FIG. 1, indicating that the host player may receive a treat (a snack, drink, walk, etc.) after completing each lap of the playing path.

Alternatively, the game end may be determined by reaching a predetermined time limit, or discussing a predetermined number of the memory cards, e.g., ten or twenty cards. Completing the discussion of ten cards might be considered a "win-win" situation for host and assisting players, with the host player being provided with a reward at that point. A "double win-win" could be achieved by discussing twenty of the memory cards. The important point is that the end of the game is not set by any predetermined numerical score, as no such score is provided in the present non-competitive game. Rather, the game end may be set by consensus among host and assisting players, according to a number of factors.

In summary, the present non-competitive memory enhancement game provides a means of encouraging the sharing of memories among host players with memory impairment, and assisting players participating in the present game. The host player or players and the assisting player or players do not compete against one another, but rather work toward the same goal, which is to provide an enjoyable time for both the host player(s) and assisting player(s)

The present game encourages family members and friends to work with the host player in the development of personal memory cards used in the game, as various photographs and/or other memorabilia of the host player may be borrowed and copied by family members and friends for use in constructing the personalized memory cards of the present game, or such memorabilia from the collections of the family members and friends may be used. The resulting collection of personalized memory cards serves as an additional means of compiling a history or biography of the memory impaired individual, Of as well as a peripheral history of family and friends involved. The present game also encourages relatives, friends, and others to spend more time associating with persons living in assisted living quarters and suffering from memory impairment, by providing a tool for communicating with one another. Such communication serves to enhance the quality of life for such memory impaired persons, with the present game also serving to enhance, improve, and clarify the memories of the host player or players involved.

It is to be understood that the present invention is not limited to the embodiments described above, but encompasses any and all embodiments within the scope of the following claims.

I claim:

1. A non-competitive memory enhancement game for play by at least one host player suffering from memory impairment and at least one assisting player, said game comprising:

a playing area including a plurality of playing positions;

said playing positions comprising a plurality of different subject categories;

a plurality of memory cards;

said memory cards comprising a plurality of different subject categories each corresponding to one of said subject categories of said playing positions, said memory cards being further divided into general and individualized subjects for each of said subject categories, wherein each of said individualized subject memory cards comprises a first side with a personalized picture relating to a biographical experience of the host player and a second side including comments relating to the personalized picture;

a single player position marker for only designating movement of the host player along the playing area; and chance means for determining placement of said player position marker randomly upon one of said playing positions;

whereby the assisting player provides for a discussion of a selected one of the memory cards with the host player in order to share memories and to stimulate the memories of the host player.

2. The memory enhancement game according to claim 1, wherein each of said general subject memory cards comprises a first side with a picture of a generally known feature and a second side including comments relating to said picture.

3. The memory enhancement game according to claim 1, wherein each of said individualized subject memory cards is formed using a transparent sleeve.

4. The memory enhancement game according to claim 1, wherein said playing area comprises a game board.

5. The memory enhancement game according to claim 4, wherein said game board has a generally rectangular shape with said playing positions comprising a continuous peripheral playing path thereon.

6. The memory enhancement game according to claim 1, wherein said subject categories of said playing positions comprise special places and events, favorite things, people, and animals.

7. The memory enhancement game according to claim 1, including at least one playing position for freely selecting another of said playing positions of any of said subject categories.

8. The memory enhancement game according to claim 1, wherein each of said different subject categories comprises a plurality of identically colored playing positions, with said playing positions of said different subject categories being colored differently from one another.

9. The memory enhancement game according to claim 1, wherein said chance means is selected from the group consisting of a plurality of category cards corresponding to said plurality of different subject categories of said playing positions and of said memory cards, and a single numbered cubical die.

10. A method of playing a non-competitive memory enhancement game, comprising the following steps:

(a) selecting at least one host player suffering from memory impairment and at least one assisting player for aiding the host player;

(b) providing a playing area including a starting position and a plurality of playing positions with a plurality of subject categories;

(c) providing a plurality of memory cards, with each of the cards comprising a plurality of different subject categories, each corresponding to one of the categories of the playing positions;

(d) dividing the memory cards into general subject cards and individualized subject cards for each of the subject categories, wherein each of the general subject memory cards consists of a first side having a picture of a generally known feature and a second side including comments relating to the picture, and wherein each of the individualized subject memory cards consists of a first side with a personalized picture relating to a biographical experience of the host player and a second side including comments relating to the personalized picture;

(e) further providing a single player position marker;

(f) further providing chance means for determining placement of the player position marker randomly upon one of the playing positions during the course of play;

(g) determining the order of play among the players when a plurality of host players play;

(h) placing the single position marker upon the starting position of the playing area;

(i) moving the position marker to one of the player positions of the playing area, the moving step only designating movement of the host player along the playing area;

(j) selecting one of the memory cards corresponding to the one of the player positions upon which the marker has been placed;

(k) providing for a discussion by the assisting player of the selected one of the memory cards with the host player, wherein the assisting player facilitates in stimulating the memories of the host player; and (l) continuing the game according to the above steps until reaching the end of the game.

11. The method according to claim 10, including the step of forming the playing area as a game board.

12. The method according to claim 11, including the step of forming the game board in a generally rectangular shape with the playing positions comprising a continuous peripheral playing path thereon.

13. The method according to claim 10, including the step of providing subject categories comprising special places and events, favorite things, people, and animals for the playing positions.

14. The method according to claim 10, including the step of providing at least one playing position for freely selecting another of the playing positions of any of the subject categories.

15. The method according to claim 10, including the step of coloring the playing positions of each of the different subject categories differently from one another, and coloring each of the playing positions within each different subject category identically to one another.

16. The method according to claim 10, including the steps of:

(a) providing a single numbered cubical die; and (b) selecting the chance means from the group consisting of a plurality of category cards corresponding to the plurality of different subject categories of the playing positions and of the memory cards, and the single numbered cubical die.

* * * * *